US007322308B2

(12) United States Patent
De Baan

(10) Patent No.: US 7,322,308 B2
(45) Date of Patent: Jan. 29, 2008

(54) MOORING APPARATUS WITH MOVEABLE BALLAST WEIGHT

(75) Inventor: Jacob De Baan, Maassluis (NL)

(73) Assignee: Bluewater Energy Services BV, Hoofddorp (NL)

( * ) Notice: Subject to any disclaimer, the term of this patent is extended or adjusted under 35 U.S.C. 154(b) by 151 days.

(21) Appl. No.: 11/385,088

(22) Filed: Mar. 21, 2006

(65) Prior Publication Data

US 2006/0207487 A1 Sep. 21, 2006

(30) Foreign Application Priority Data

Mar. 21, 2005 (GB) ..... 0505759.1

(51) Int. Cl.
*B63B 21/00* (2006.01)
*B63B 22/02* (2006.01)

(52) U.S. Cl. ..... 114/230.1; 441/3

(58) Field of Classification Search ..... 114/230.1, 114/230.14–230.19, 230.2, 230.22–230.27, 114/249, 251; 441/3–5
See application file for complete search history.

(56) References Cited

U.S. PATENT DOCUMENTS

| | | | | |
|---|---|---|---|---|
| 4,099,542 | A | 7/1978 | Gibbons | |
| 4,393,906 | A * | 7/1983 | Gill | 141/387 |
| 4,416,306 | A | 11/1983 | Le Devehat | |
| 4,530,302 | A | 7/1985 | Petersen | |
| 4,784,079 | A * | 11/1988 | Poldervaart | 114/230.14 |
| 6,851,994 | B2 * | 2/2005 | Boatman et al. | 441/4 |
| 7,066,219 | B2 * | 6/2006 | Poldervaart et al. | 141/387 |

FOREIGN PATENT DOCUMENTS

| | | |
|---|---|---|
| EP | 0 105 976 A1 | 4/1984 |
| EP | 1 283 159 A1 | 2/2003 |
| FR | 2367654 | 12/1976 |
| WO | WO 9948752 | 9/1999 |
| WO | WO 9950173 | 10/1999 |

* cited by examiner

*Primary Examiner*—Jesus Sotelo
*Assistant Examiner*—Daniel V. Venne
(74) *Attorney, Agent, or Firm*—Fulwider Patton, LLP

(57) ABSTRACT

A mooring apparatus for mooring first and second vessels, (1, 7) together in a heavy seaway ofFshore is described. The apparatus is for tandem mooring using soft yoke technology. The apparatus consists of a rigid arm (2) with a longitudinal axis and first and second ends. The arm is mountable to a first vessel (1) so that its longitudinal axis is substantially parallel to that of the vessel (1) and is rotatable about a substantially horizontal axis (3) which is substantially perpendicular to the longitudinal axis and is located between the first and second ends. A tension member (4) is pivotally mounted to the second end of the arm (2) and can be connected to the second vessel (7). A ballast weight (8) is moveably mounted on the arm (2) and can be moved longitudinally along the arm by a drive means (9). Actuation means (10, 11, 12) is pivotally mounted to the first end of the arm (2) and controls rotation of the arm (2) about the pivot axis (3) Provision of the moveable ballast weight (8) allows the second vessel (7) to be connected to the apparatus with relatively small connecting loads. However, once connected the ballast weight (8) prevents the yoke masses being excited due to motions of the second vessel (7).

8 Claims, 4 Drawing Sheets

MOORING APPARATUS WITH MOVEABLE BALLAST WEIGHT

The present invention relates to apparatus for disconnectably mooring one vessel to another in a heavy seaway off-shore. Such disconnectable moorings are frequently required, for example, in off-shore oil and gas fields, where a shuttle tanker needs to moor in close proximity to a permanently anchored storage tanker, in order to facilitate the transfer of oil or liquefied gases so that these may be transported away by the shuttle tanker.

Generally, two types of mooring exist making this feasible. These are side-by-side mooring and tandem mooring. The present invention concerns tandem mooring, in which the two vessels are moored in line with each other, e.g. when the bow of the shuttle tanker approaches and is moored to the stern of the storage tanker.

Some known tandem moorings make use of so-called "soft yoke" technology, whereby the required restoring forces imposed on the shuttle tanker and the storage tanker are created by a submerged ballastable rigid arm or yoke and transferred to a articulated tether. Examples of such ballastable mooring systems can be found in NL 173254 and EP 0079404.

In general, the configurations described in these patents do not lend themselves to a relatively quick and easy connection operation because the masses involved are large. The fact that the storage vessel naturally moves in a seaway also has an impact on the behaviour of the yoke system.

Other currently proposed systems have the yoke above water and hook-up to the shuttle tanker is made at the other side of the yoke. Large horizontal swing motions of the ballasted end of the yoke take place because the tethers and the ballast act as a pendulum continuously being excited by the motions of the storage tanker.

The present invention provides mooring apparatus for mooring first and second vessels together, comprising a rigid arm with a longitudinal axis and first and second ends, wherein the arm is mountable to a first vessel so that its longitudinal axis is substantially parallel to the longitudinal axis of the vessel and so as to be rotatable about a substantially horizontal pivot axis substantially perpendicular to the longitudinal axis and located between the first and second ends, a tension member pivotally mounted to the second end of the arm and connectable in use to a second vessel; a ballast weight moveably mounted on the arm, drive means operable to move the ballast weight longitudinally along the arm and actuation means pivotally mounted to the first end of the arm operable to control rotation of the arm about the pivot axis.

Provision of a moveable ballast weight in this way allows the second vessel to be connected to the apparatus with relatively small connecting loads, but once connected, prevents the yoke masses being excited due to motions of the storage tanker.

Preferably, the tension member includes buoyancy means. This allows the tension member to float in a substantially vertical position with its upper end at the waterline in order to facilitate its connection to the second vessel.

Preferably, the actuation means is operable to cause rotation of the arm about the pivot axis in one direction and to act as damping means to restrain uncontrolled rotation of the arm in the opposite direction. In this way, it can be used to locate the arm in the optimal position for different operations and will restrain free-fall of the arm when it is disconnected from a second vessel.

Conveniently, the actuation means will comprise a piston pivotally mounted to the arm and slidably received in a hydraulic cylinder which is pivotally mountable to the first vessel. It is also preferable if the actuation means includes stop means to limit extension of the piston.

The present invention also provides a floating vessel incorporating a mooring apparatus of the aforementioned type and fluid transfer means connectable to a second vessel for transfer of fluid between the two.

Typically, the apparatus will be connected to the stern of the first vessel, and extend aft of the vessel.

The present invention also provides a method for mooring first and second vessels together using the aforementioned apparatus. The method comprises the steps of providing a first vessel with the mooring apparatus, locating the ballast weight close to, but outboard of, the pivot axis, operating the actuation means to pivot the arm about the pivot axis such that the second end of the arm is lower than the first end, connecting a flexible member between the second vessel and the tension member, using the flexible member to pull the second vessel towards the first vessel until the tension member can be directly connected to the second vessel and subsequently moving the ballast weight longitudinally to the second end of the arm.

The present invention will now be described in detail by way of example only, with reference to the accompanying drawings in which.

Figure 1:
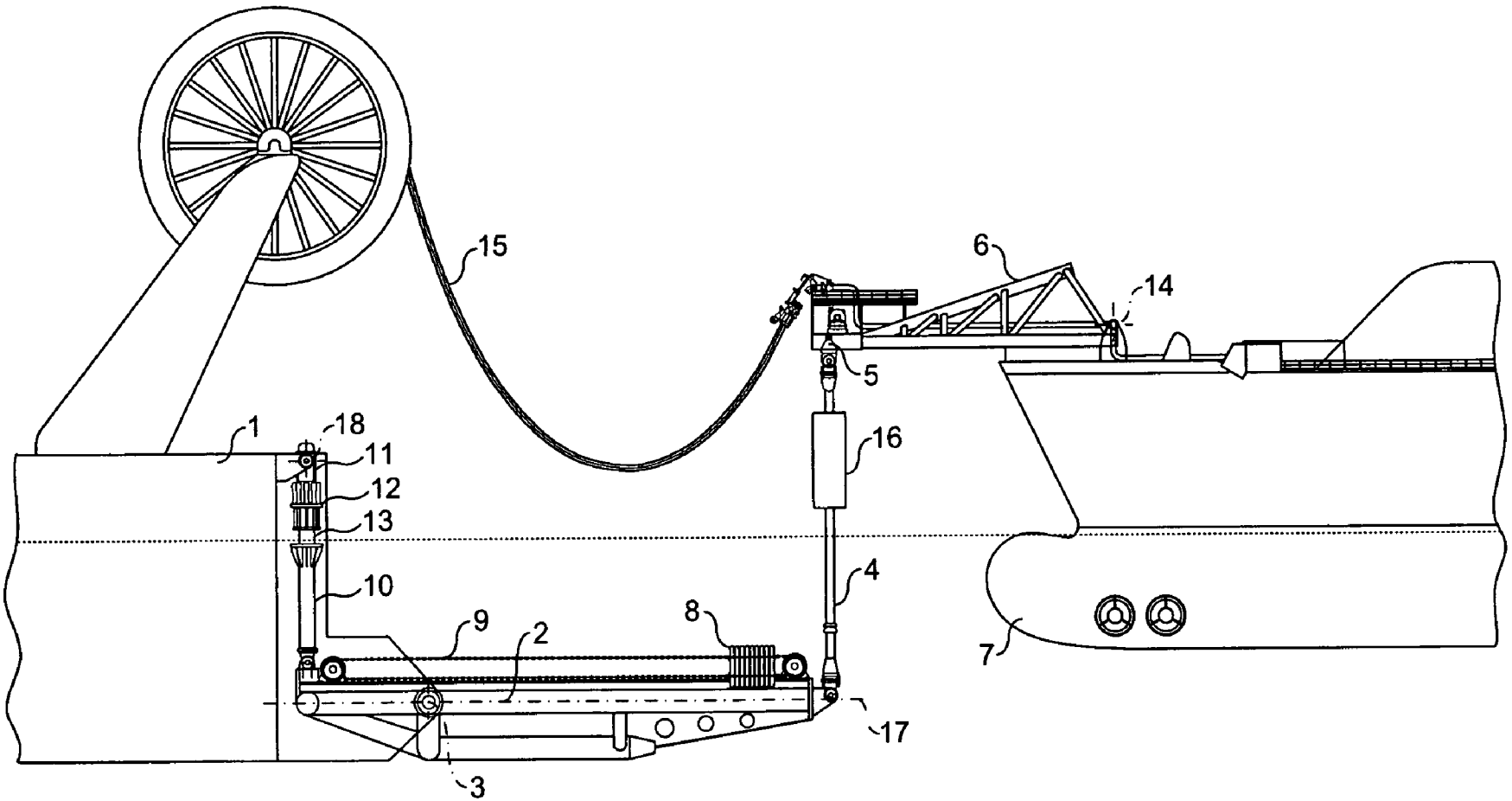
FIG. 1 is a partially sectioned side view of a mooring system in accordance with one embodiment of the present invention.
Figure 2:
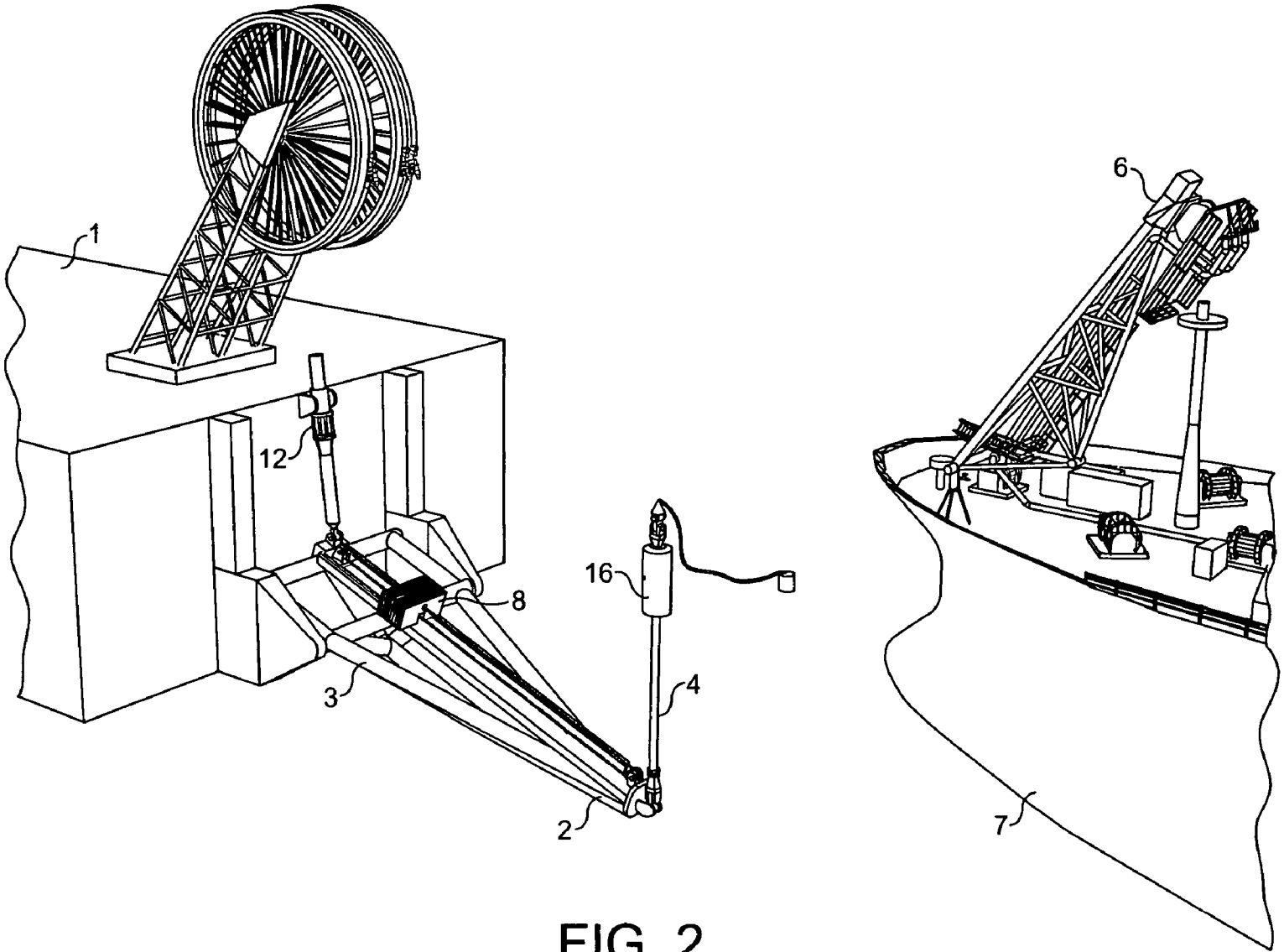
FIG. 2 is a perspective view of the system of FIG. 1 as the shuttle tanker approaches the storage tanker.

Referring to FIG. 1, a vessel such as a storage tanker 1, which may be may be permanently anchored, is fitted with a structural framework consisting of an arm or yoke 2 extending aft of the vessel. Thus the longitudinal axis of the yoke 2 is substantially parallel to the longitudinal axis of the vessel 1. The yoke 2 is preferably submerged and located between the keel and the waterline of the storage tanker 1. As best seen in FIG. 2, the yoke 2 is a generally A-shaped frame, which is free to pivot about a nominally horizontal axis 3 located a short distance aft of the main body of the vessel 1.

At the outboard, free end of the yoke 2, i.e. at the apex of the A-frame, a tether 4 is pivotally mounted. This may be a substantially rigid elongate member, or a flexible member such as a chain or cable, provided with buoyancy means 16 at the free end remote from the yoke 2. In this way it remains substantially vertical, with the buoyancy means 16 floating close to or at the waterline when no shuttle tanker is moored to it, as shown in FIG. 2.

Figure 3:
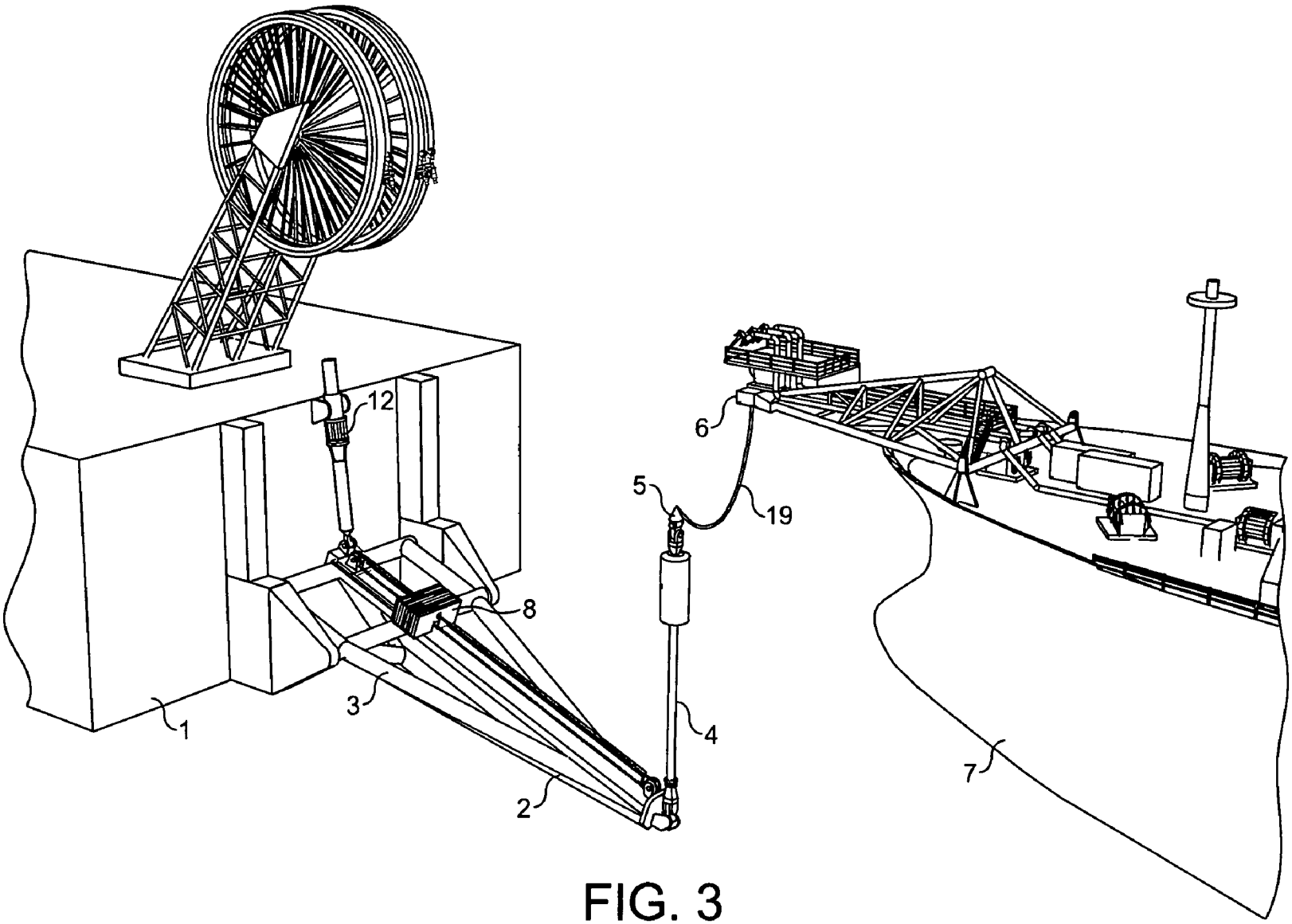
FIG. 3 is a perspective view of the system during the hook-up procedure.
Figure 4:
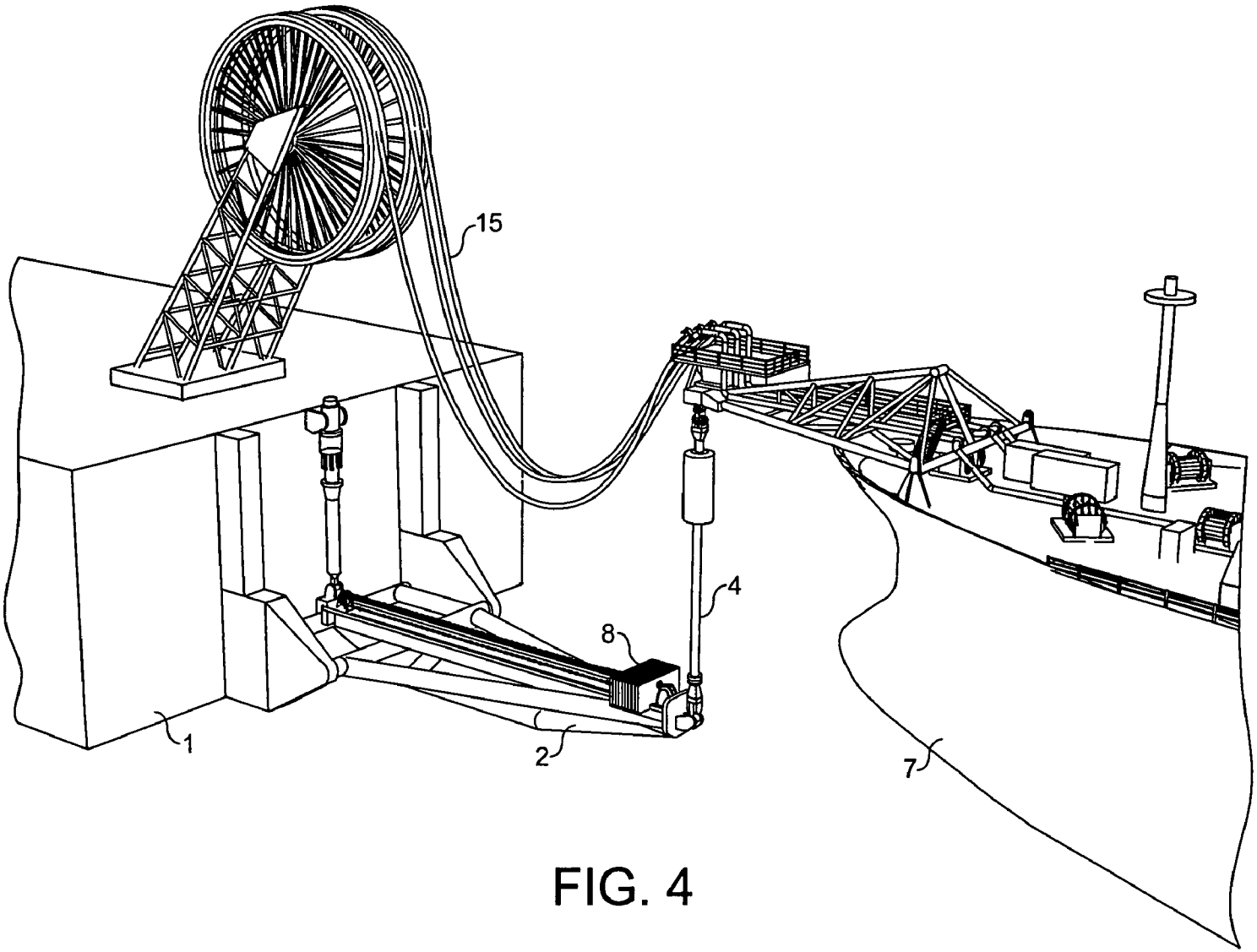
FIG. 4 is a perspective view of the system when the shuttle tanker is moored.

The upper end 5 of the tether 4 can be disconnectably fitted to an outrigger 6 of another vessel such as a shuttle tanker 7 in use, as seen in FIGS. 1 and 3. The outrigger 6 is preferably pivotably mounted on the shuttle tanker 7 so that it can rotate about axis 14 in order to lie fully within the confines of the vessel's upper deck when in transit, as shown in FIG. 2, and only be moved into its outwardly extending position when required.

A ballast weight 8 is provided on the yoke 2, lying substantially on a central longitudinal axis 17 of the yoke 2 perpendicular to the pivot axis 3. The ballast weight 8 is moveable back and forth along the axis by any suitable powered drive mechanism 9.

At its inboard end i.e. closest to the vessel 1, the yoke 2 is connected to a rod 10 which extends upwards and is slidable through a sleeve 11 which is pivotally mounted to the vessel 1 for rotation about a nominally horizontal axis 18. A hydraulic jack system 12 is fitted to the sleeve 11. This serves as a free fall damping means for the end of the yoke 2 (as discussed further below) and engages against a stopper plate 13 fixed on the rod 10 at a pre-determined position below the sleeve 11.

In the condition shown in FIG. 2, before the shuttle tanker 7 is moored, the yoke 2 extends downwardly away from the vessel 1. However, the hydraulic system 12 can also be extended to push rod 10 downwardly, thereby causing yoke 2 to pivot around the axis 3. This lowers its inboard end and raises its outboard end to bring it into a nominally horizontal position. This may be useful for example during transit of the vessel from its building yard or for maintenance purposes.

A fluid transfer system 15 is provided for transferring fluid from the storage tanker 1 to the shuttle tanker 7. This may take any convenient shape and form, and typically will consist of multiple articulated steel or flexible pipelines with quick connect and disconnect devices.

In use, as seen in FIG. 2, when no shuttle tanker 7 is moored, the ballast weight 8 is located just outboard of the pivot axis 3. The hydraulic system 12 maintains the yoke 2 in its downwardly tilted position so that it is below the keel of the approaching shuttle tanker 7 to avoid any collision risk. The tether 4 extends upwardly with its buoyancy means 16 floating roughly at the waterline.

As seen in FIG. 3, as the shuttle tanker 7 approaches, the outrigger 6 is pivoted into its outwardly extending position. A wire rope 19 is connected between the top of the tether 4 and the outrigger 6, with which the shuttle tanker 7 pulls itself in towards the tether 4, and also brings the yoke 2 up into a nominally horizontal position, until the upper end 5 of the tether 4 can be directly connected to the outrigger 6.

At this stage, since the ballast weight 8 is close to the pivot axis 3, the load on the wire rope 19 is relatively low. Furthermore the hydraulic system 12 cannot exert tension forces on the tether 4, and so the shuttle tanker 7 can connect the upper end 5 of the tether 4 to its outrigger 6 without restraint.

Once the shuttle tanker 7 is properly moored and all the necessary connections have been made, the ballast weight 8 is moved further outboard towards the end of the yoke 2. This increases the tension in the tether 4 to the required level for station keeping of the shuttle tanker 7. In addition, motions of the storage tanker 1 do not lead to excitation of the yoke 2 masses, due to the ballast 8.

In this way, an improved mooring system is provided which allows for a relatively quick and easy connection procedure and which avoids the masses of the yoke structure being excited by movement of the storage tanker.

The invention claimed is:

1. Mooring apparatus for mooring first and second vessels together comprising:

a rigid arm with a longitudinal axis and first and second ends, the arm being mountable to a first vessel so that its longitudinal axis is substantially parallel to the longitudinal axis of the vessel and so as to be rotatable about a substantially horizontal pivot axis which is substantially perpendicular to the longitudinal axis and located between the first and second ends;

a tension member pivotally mounted to the second end of the arm and connectable in use to a second vessel;

a ballast weight movably mounted on the arm;

drive means operable to move the ballast weight longitudinally along the arm;

and actuation means pivotally mounted to the first end of the arm operable to control rotation of the arm about the pivot axis.

2. Mooring apparatus as claimed in claim 1, wherein the tension member includes buoyancy means.

3. Mooring apparatus as claimed in claim 1, wherein the actuation means is operable to cause rotation of the arm about the pivot axis in one direction and to act as damping means to restrain uncontrolled rotation in the opposition direction.

4. Mooring apparatus as claimed in claim 3, wherein the actuation means comprises a piston pivotally mounted to the arm and slidably received in a hydraulic cylinder pivotally mountable to the first vessel.

5. Mooring apparatus as claimed in claim 4, further comprising stop means to limit extension of the piston.

6. A floating vessel incorporating a mooring apparatus as claimed in claim 1 and further including fluid transfer means connectable to a second vessel for transfer of fluid thereto.

7. A floating vessel as claimed in claim 6, wherein the mooring apparatus is connected to the stern of the first vessel and extends aft therefrom.

8. A method for mooring first and second vessels together comprising the steps of providing the first vessel with a mooring apparatus as claimed in claim 1; locating the ballast weight close to, but outboard of, the pivot axis; operating the actuating means to pivot the arm about the pivot axis such that the second end of the arm is lower than the first end; connecting a flexible member between the second vessel and the tension member; using the flexible member to pull the second vessel towards the first vessel until the tension member can be directly connected to the second vessel; and moving the ballast weight longitudinally to the second end of the arm.

* * * * *